US012065914B2

(12) United States Patent
McEvoy et al.

(10) Patent No.: US 12,065,914 B2
(45) Date of Patent: Aug. 20, 2024

(54) COMPOSITE FRACTURING TREE

(71) Applicant: Vault Pressure Control, LLC, Houston, TX (US)

(72) Inventors: Travis Kyle McEvoy, Houston, TX (US); Dwayne E. Bartek, Houston, TX (US); Anthony Lee Hogg, Prague, OK (US)

(73) Assignee: Vault Pressure Control, LLC, Houston, TX (US)

( * ) Notice: Subject to any disclaimer, the term of this patent is extended or adjusted under 35 U.S.C. 154(b) by 115 days.

(21) Appl. No.: 17/831,732

(22) Filed: Jun. 3, 2022

(65) Prior Publication Data

US 2022/0389801 A1 Dec. 8, 2022

Related U.S. Application Data

(60) Provisional application No. 63/196,777, filed on Jun. 4, 2021.

(51) Int. Cl.
*E21B 43/26* (2006.01)
*E21B 33/068* (2006.01)
*E21B 34/02* (2006.01)

(52) U.S. Cl.
CPC ..... *E21B 43/2607* (2020.05); *E21B 33/068* (2013.01); *E21B 34/02* (2013.01)

(58) Field of Classification Search
CPC ..... E21B 43/2607; E21B 33/068; E21B 34/02
See application file for complete search history.

(56) References Cited

U.S. PATENT DOCUMENTS 4,215,749 A * 8/1980 Dare ..... E21B 29/08 137/68.13
2013/0032327 A1* 2/2013 He ..... E21B 33/068 166/75.15
2014/0102717 A1* 4/2014 Cherewyk ..... E21B 33/10 166/381
2014/0262302 A1* 9/2014 Ferguson ..... E21B 33/068 166/318
2014/0360720 A1* 12/2014 Corbeil ..... E21B 33/068 166/284
2015/0267505 A1* 9/2015 McEvoy ..... E21B 34/02 166/97.1

(Continued)

*Primary Examiner* — Shane Bomar
(74) *Attorney, Agent, or Firm* — Morgan, Lewis & Bockius LLP

(57) ABSTRACT

A composite fracturing tree includes an operating valve and a master valve in fluid communication with the operating valve. The master valve includes an inlet portion in fluid communication with the operating valve, an outlet portion, and a gate portion. The gate portion is disposed between the inlet portion and the outlet portion. The gate portion is moveable between a flow position and an occluding position. In the flow position, the gate portion permits flow between the inlet portion and the outlet portion. In the occluding position, the gate portion prevents flow from the inlet portion to the outlet portion. The gate portion is actuated from the flow position to the occluding position with a closing force and from the occluding position to the flow position with an opening force. The master valve allows for the closing force to reduced compared to conventional fracturing valves.

6 Claims, 8 Drawing Sheets

(56) References Cited

U.S. PATENT DOCUMENTS

| | | | | |
|---|---|---|---|---|
| 2015/0292297 | A1* | 10/2015 | Kajaria | E21B 43/2607 166/250.01 |
| 2017/0009785 | A1* | 1/2017 | McEvoy | F16K 31/1268 |
| 2017/0022777 | A1* | 1/2017 | Allen | E21B 43/2607 |
| 2018/0320476 | A1* | 11/2018 | McEvoy | E21B 34/02 |
| 2020/0182240 | A1* | 6/2020 | Nowell | F16J 15/184 |
| 2020/0355041 | A1* | 11/2020 | McEvoy | F16K 3/207 |
| 2021/0199201 | A1* | 7/2021 | Choate | F16K 3/314 |
| 2021/0262315 | A1* | 8/2021 | Beason | E21B 41/00 |

* cited by examiner

COMPOSITE FRACTURING TREE

REFERENCE TO RELATED APPLICATIONS

This application claims priority to U.S. Provisional Application No. 63/196,777, filed Jun. 4, 2021, the entire disclosure of which being incorporated herein by this reference.

TECHNICAL FIELD

The present disclosure relates generally to a composite fracturing tree and more particularly, to composite fracturing trees with one or more valves that can be closed with a reduced amount of force.

BACKGROUND

Fracturing trees are used to control the flow of fracturing fluid for a fracturing operation during the production of oil and gas. A typical fracturing tree is an assembly of one or more valves, spools, and pressure gauges fitted to the wellhead to control the flow of fracturing fluid. A fracturing tree can include an upper and lower master valve, a flow cross, wing valves, a goat head, and swab valves. A composite fracturing tree includes multiple types of fracturing valves to optimize the functions of the fracturing tree. However, often times in the industry operators do not consider the optimization of the functions of the fracturing tree. Particular arrangements of valves can optimize safety and operational considerations to reduce costs, increase safety, and increase efficiencies during production of oil and gas.

Composite fracturing trees control high pressure and high-volume fluids. The fluids travel through the various valve cavities of the composite fracturing tree. During operation, there may be a high pressure differential across each of these valves. This pressure differential can create significant force on the valves and can make it difficult to actuate the valves. In particular, it may be difficult to close a valve during an emergency situation.

In certain conventional applications, valves and actuators can be sized, specified, or otherwise designed to exert and withstand the significant force needed to actuate valves during high pressure differentials. However, valves and actuators that are selected to exert and withstand high actuation forces may be larger, heavier, and more expensive than valves that are otherwise suitable for an application.

Accordingly, there is a desire to provide a fracturing tree that addresses these shortcomings and provides a solution that requires less actuation force and is suitable for emergency situations and improve the reliability of the fracturing tree.

SUMMARY

A composite fracturing tree includes an operating valve and a master valve in fluid communication with the operating valve. The master valve includes an inlet portion in fluid communication with the operating valve, an outlet portion, and a gate portion. The gate portion is disposed between the inlet portion and the outlet portion. The gate portion is moveable between a flow position and an occluding position. In the flow position, the gate portion permits flow between the inlet portion and the outlet portion. In the occluding position, the gate portion prevents flow from the inlet portion to the outlet portion. The gate portion is actuated from the flow position to the occluding position with a closing force and from the occluding position to the flow position with an opening force. The master valve allows for the closing force to reduced compared to conventional fracturing valves.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

Figure 1:
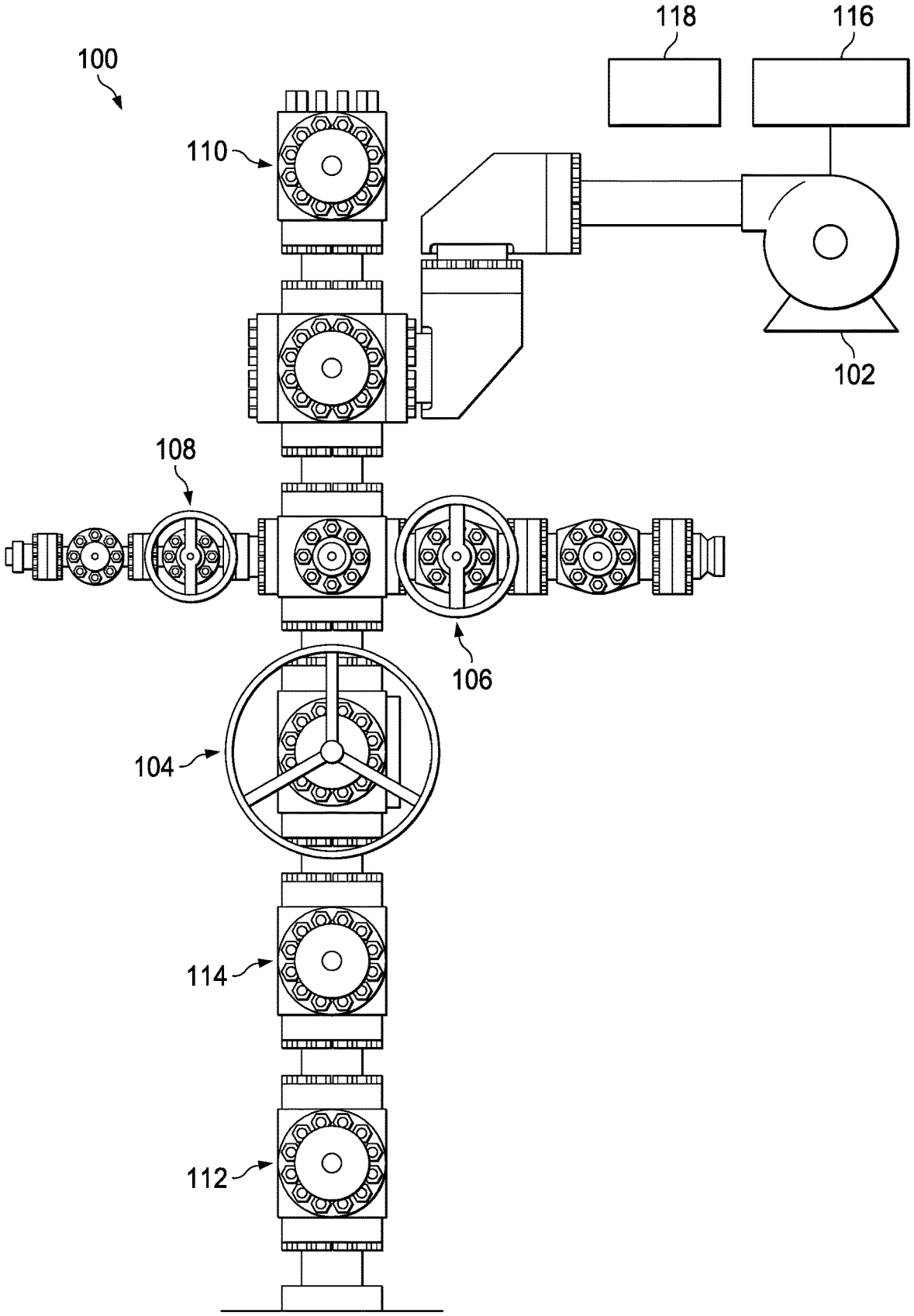
FIG. 1 is an illustration of a composite fracturing tree, according to some embodiments.

Exemplary embodiments are illustrated in the referenced figures. It is intended that the embodiments and figures disclosed herein are to be considered illustrative rather than restrictive. No limitation on the scope of the technology that follows is to be imputed to the examples shown in the drawings and discussed herein.

The present disclosure describes embodiments of a fracturing tree and methods of use thereof. As described herein, embodiments of the fracturing tree and methods of use thereof address the issues described with respect to traditional fracturing trees.

Fracturing trees are used to control the flow of fracturing fluid for a fracturing operation during the production of oil and gas. As described herein, fracturing trees can control the flow of high pressure and high volume fluids. High pressure fluid can create high pressure differentials across the valves of the fracturing tree.

However, high pressure differentials across the valves of the fracturing tree can create significant force on the valves, making it difficult to actuate the valves. Further, it may be difficult to close a valve during an emergency situation. Accordingly, traditional fracturing trees and valves can be sized, specified or otherwise designed to exert and withstand the significant force needed to actuate valves during high pressure differentials, without being optimized for operations. Typically, valves and actuators that are selected to exert and withstand high actuation forces are larger, heavier, and more expensive than valves that are otherwise suitable for an application that would require lower pressures.

Therefore, it is desired to provide a fracturing tree with valves that can be actuated during high pressure differentials that are optimized for operations. Further, it is desired to provide a fracturing tree and/or valves that can be actuated to a closed position during an emergency situation with a reduced amount of force.

As described herein, embodiments of the fracturing tree can include master valves that are configured to have a closing force that is lower than the opening force, allowing the valve to be closed with a reduced amount of force while experiencing a high pressure differential, such as during an emergency situation. Further, certain embodiments of the fracturing tree include valves that include an upper rotating stem and a lower translating stem or a reverse acting arrangement, both of which allow a valve to be closed with a reduced amount of force while experiencing a high pressure differential.

FIG. 1 is an illustration of a fracturing tree 100, according to some embodiments. The fracturing tree 100 is designed to control the flow of fracturing fluid for a fracturing operation in connection with the production of oil and gas. Fracturing fluid is typically pumped downhole at high flow rates and pressures. Therefore it is necessary for the fracturing tree to accommodate these parameters. In some embodiments, the fracturing tree 100 is designed to control the flow of fracturing fluid as it is pumped out of the well. The fracturing tree 100 is designed to direct fluid and to control the isolation of pressure.

In an embodiment, the fracturing tree 100 directs fluid flow to various components of the fracturing operation. The fracturing fluid is pumped into a reservoir through the fracturing tree 100 by the pump 102.

In the depicted example, the fracturing tree 100 includes an operating valve 104 to control the flow of fracturing fluid to fracturing components. Operating valves, such as the operating valve 104 can be used to control flow of fracturing fluid during regular operations. In some applications, the operating valve 104 is cycled between valve positions for every operation performed, and therefore can be optimized and maintained for a significant number of opening and closing cycles.

In some embodiments, the operating valve 104 is a plug valve. A plug valve is a valve with a cylindrical or conically tapered "plug" which can be rotated inside a valve body to control flow through the valve. Advantageously, the use of a plug valve minimizes the number of turns required to cycle the valve and minimizes the required torque. Further, a plug valve construction has a minimal open cavity volume which decreases the required grease to maintain the operation of the valve.

In certain embodiments, the fracturing tree 100 includes one or more wing valves 106, 108. One of the wing valves 106, 108 can control and isolate production within the well and the other wing valve 106, 108 can allow for treatment or control of the well. The wing valves 106, 108 can be disposed above or below the operating valve 104.

In an embodiment, the fracturing tree 100 comprises an access valve 110. In some applications, the access valve 110 may be primarily used to permit wireline operations in the well. The access valve 110 can be a balance stem gate valve or a plug valve. During operation, the access valve 110 does not cycle unless actuated, reducing the risk of inadvertently shearing the wire during a wireline operation. During operation of the fracturing tree 100, there is typically no flow through the access valve 110, reducing grease loss and maintenance requirements of the access valve 110.

The fracturing tree 100 further comprises one or more master valves to control the isolation of pressure through the fracturing tree 100. The master valves 112, 114 can each shut off flow to the fracturing tree 100 and/or fracturing components in various situations or events, including in emergency events such as uncontrolled well pressures that require emergency isolation of the surface equipment from the well. For this reason, master valves 112, 114 are also sometimes referred to as safety valves. In the depicted example, a gate valve is used as one or more of the master valves 112, 114. Advantageously, the use of gate valves as master valves allows for the valves to operate under emergency conditions more safely, prevents undue wear and damage to the operational valves of the fracturing tree, and allows the operational valves to perform more effectively.

In an embodiment, the fracturing tree 100 includes a manually operated master valve 112. As described herein, an operator can manually open and close the master valve 112 to control flow through an inlet portion and an outlet portion of the master valve 112, and therefore the fracturing tree 100.

Further, in some embodiments, the fracturing tree 100 includes an actuated master valve 114. The master valve 114 can be electronically, hydraulically, or pneumatically actuated to open and close the master valve 114 to control flow through an inlet portion and an outlet portion of the master valve 114, and therefore the fracturing tree 100. In various embodiments, the fracturing tree 100 can include a single manually operated master valve 112, a single actuated master valve 114, and/or a combination of the manually operated master valve 112 and the actuated master valve 114 in fluid communication with each other. Optionally, the actuated master valve 114 can be disposed above or below the master valve 112. As described herein, the fracturing tree 100 can be configured or optimized by selecting master valves 112, 114 with a particularized set of required opening and closing forces based on the intended use or operation of the master valves 112, 114 and the fracturing tree 100.

During certain operations, there is a pressure differential across the master valves 112, 114. This pressure differential creates gate drag on the gate valve, which can make it difficult to actuate the valve. In some applications, to facilitate actuation of the master valves 112, 114, gate drag on the valves is reduced by equalizing the pressure across the master valves 112, 114. Further, the equalized pressure across the master valves 112, 114 may be lower than the rated working pressure of the valves. Advantageously, by equalizing fluid pressure across the master valves 112, 114, the amount of force required to actuate the master valves 112, 114 can be significantly reduced. Further, by reducing the amount of force needed to actuate the master valves 112, 114, smaller, less expensive actuators can be used to actuate the master valves 112, 114. Further, in some applications, by reducing the amount of force required to actuate the master valves 112, 114, various gate valve designs can be utilized for different master valves in the arrangement.

In the depicted example, a controller 116 can reduce or stop the flow of fluid through the master valves 112, 114 to reduce the amount of force needed for actuation of the master valves 112, 114. As illustrated, the controller 116 is operatively connected to pump 102 to control the operation of the pump 102. Therefore, the controller 116 can reduce the output of the pump 102 to reduce or stop flow through the master valves 112, 114.

In some embodiments, the controller 116 identifies an actuation event in which it is desired to actuate a master valve 112, 114. In response to an actuation event, the controller 116 can equalize pressure through the master valve 112, 114 to facilitate actuation of the respective valve as described above. The controller 116 can identify an actuation event based on operating parameters of the fracturing tree 100 and/or an operator's actions (e.g. an input to the controller 116 and/or initial actuation of the master valve 112).

Optionally, the controller 116 can automatically direct the master valve 114 to close in response to the actuation event. In some embodiments, the actuation of the master valve 114 equalizes the pressure across the master valve 112, permitting the master valve 112 to be manually actuated.

Further, in some embodiments, the master valve 112, 114 can be configured to default to a closed position in response to a failure of the controller 116, other control systems, or other portions of the fracturing tree 100. The master valve 112, 114 can include a closing mechanism to mechanically return the master valve 112, 114 to a closed position unless the valve is actively held open by some other force. The closing mechanism can include a spring, a hydraulic actuator, or a biasing member. In some embodiments, the master valve 114 can include an actuator or an additional controller to return the master valve 114 to a closed position in the absence of instructions to open the valve.

In some applications, the controller 116 can be a standalone component to control the output of the pump 102 in connection with the operation of the master valves 112, 114. Further, the controller 116 can be powered by a separate battery 118 to allow for a separate power source from other control systems associated with the fracturing tree 100. Advantageously, by isolating the functions and the power source of the controller 116, the controller 116 can facilitate operation of the master valves 112, 114 even if other systems are unavailable due to component and/or power failure. Optionally, the controller 116 can be integrated with other control systems configured to operate other aspects of the fracturing tree 100.

Figure 2:
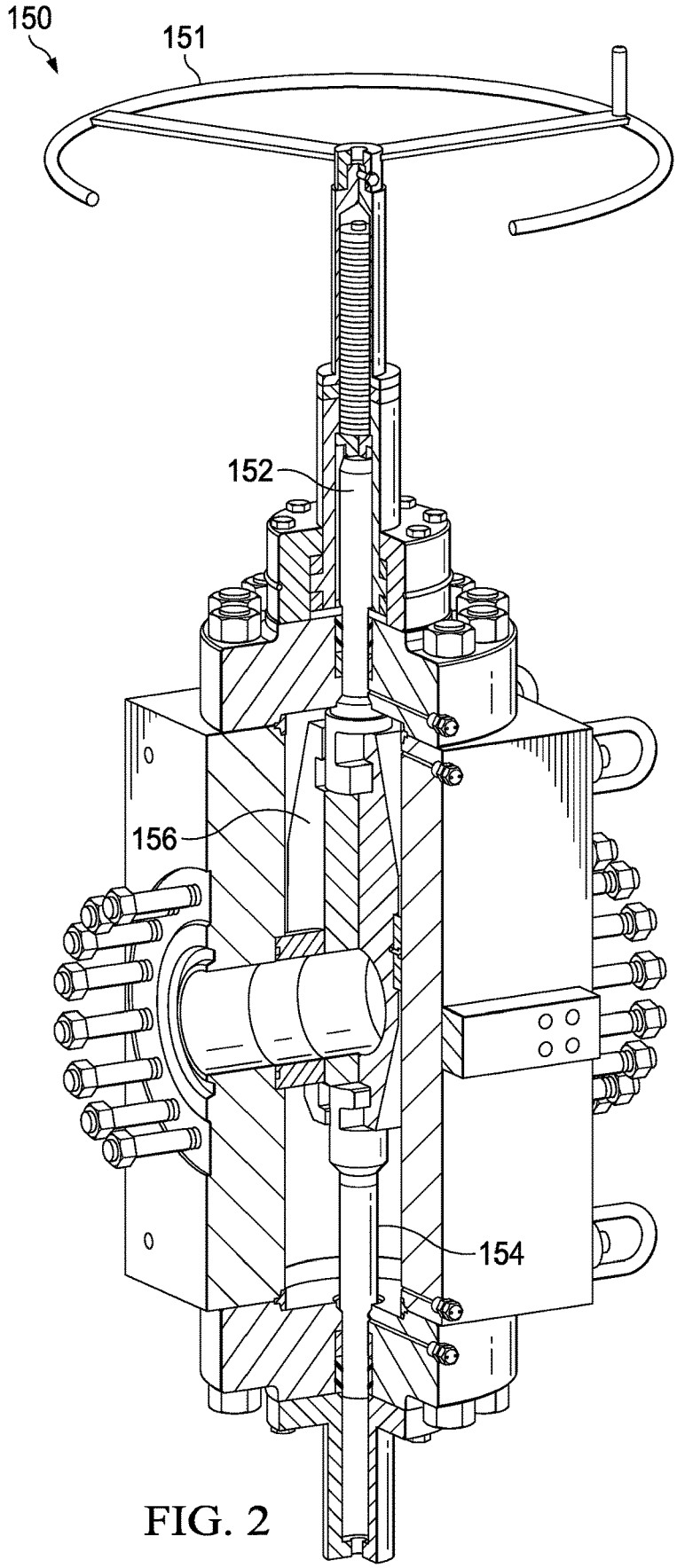
FIG. 2 is a cross-sectional view of a manually actuated balanced stem gate valve, according to some embodiments.

In some embodiments, certain fracturing trees can utilize balanced stem gate valves as master valves. FIG. 2 is a cross-sectional view of a manually actuated balanced stem gate valve 150, according to some embodiments. The balanced stem gate valve 150 controls flow between an inlet and an outlet of the valve. In the depicted example, the balanced gate valve 150 includes a gate 156 to control flow through the balanced gate valve 150. The gate 156 can be moved by a first stem 152 extending from the upper end of the gate 156 which allows the gate 156 to be opened and closed. As illustrated, the first stem 152 can be actuated by a handwheel 151 that is in threaded engagement with first stem 152 to change the position of the gate 156.

Figure 3:
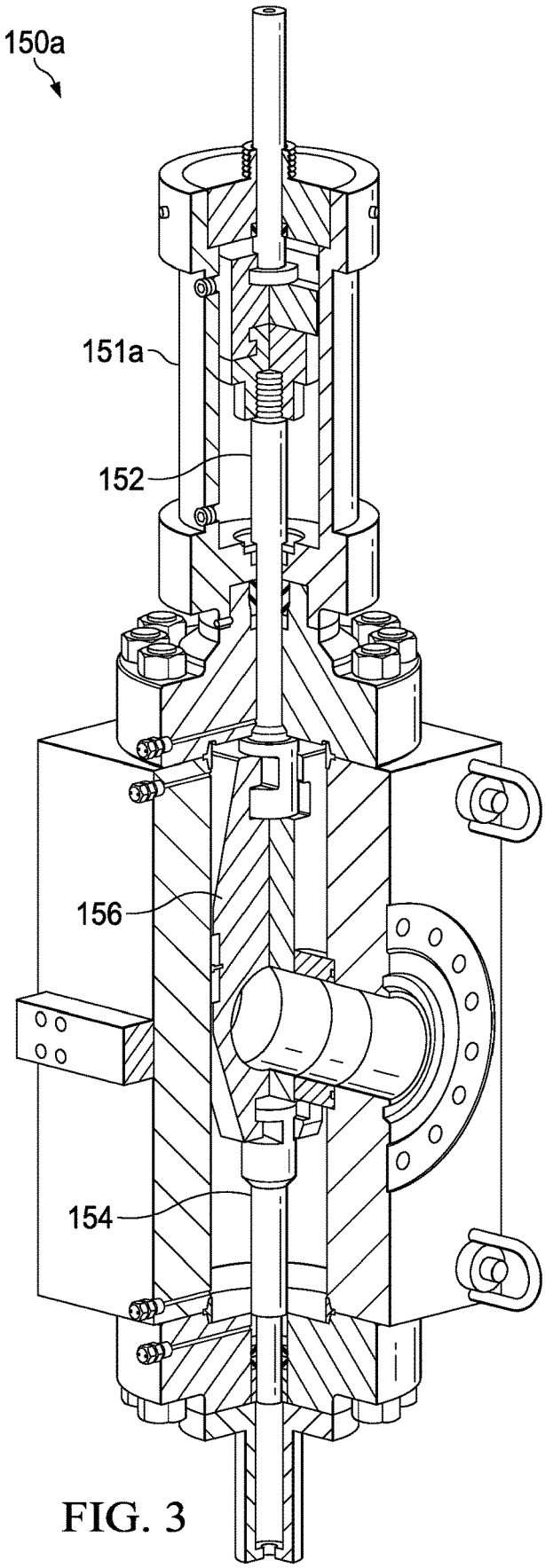
FIG. 3 is a cross-sectional view of a hydraulically actuated balanced stem gate valve, according to some embodiments.

With reference to FIG. 3, which depicts a cross-sectional view of a hydraulically actuated balanced stem gate valve 150*a*, according to some embodiments, the first stem 152 can be moved by an actuator 151*a* that is coupled to the first stem 152 to change the position of the gate 156. In the depicted example, the actuator 151*a* is a hydraulic actuator. In some embodiments, the hydraulic actuator can be a single action piston that urges the gate 156 in a single direction or a double action piston that can move the gate 156 upward or downward.

With reference to FIGS. 2 and 3, during operation, net pressure acting in the direction of fluid flow acts upon the balanced gate valve 150, creating a force on gate 156. For example, an upward force of the fluid flow can create an upward force on the gate 156, resulting in stem thrust. Stem thrust increases the amount of force required to actuate the balanced gate valve 150 which can be correlated to the pressure of the fluid flow in the valve cavity. The balanced gate valve includes a balance stem 154 extending through the valve cavity which balances the stem thrust exerted on the gate 156, facilitating the actuation of the gate 156. The balance stem 154 extends from the gate 156 opposite to the first stem 152 and serves to balance the stem thrust exerted on the stem 152.

Further, the difference in pressure on either side of the gate 156 creates a net force on the gate 156, resulting in gate drag, which affects the amount of force needed to actuate the balanced gate valve 150. During operation, gate drag increases the amount of force needed to actuate the balanced gate valve 150. As discussed herein with respect to FIGS. 7 and 8, the amount of force needed to actuate the balanced gate valve 150 to an open position is approximately the same as the amount of force needed to actuate the balanced gate valve 150 to a closed position.

Advantageously, by equalizing the pressures across the balanced gate valve 150, the amount of force needed to actuate the gate 156 is reduced, which facilitates actuation of the gate 156 to an occluded or closed position. Similarly, the pressure across the balanced gate valve 150 can be equalized to minimize the amount of force needed to open the gate 156.

In some applications, the pressure across the balanced gate valve 150 can be equalized by activating one or more pumps in fluid communication with the balanced gate valve 150 before actuating the gate valve 150. In particular, a pump or other flow device can increase or decrease pressure to match or otherwise equal the pressure on the other side of the gate 156.

Advantageously, by equalizing the pressure across the balanced gate valve 150 prior to or during operation, the force exerted on the gate 156 is reduced, which in turn, reduces the wear and tear on the components of the balanced gate valve 150. Accordingly, in some embodiments, a smaller, lighter, or less costly balanced gate valve 150 can be used in the place of a larger, heavier, or more costly valve with the same or improved levels of reliability and performance when the described method of equalizing pressure prior to the actuation of the balanced gate valve is utilized. Thus, less actuation forces is required because the smaller, lighter, and less costly built gate valve 150 is used. This arrangement can ultimately save time, cost, and space on the overall skid and valve tree.

Further, by equalizing the pressure across the balanced gate valve 150 prior to or during operation, the force required to actuate the valve is reduced, reducing the manual force required to be exerted to actuate the valve or the force requirements of the actuator to actuate the valve. In some embodiments, a smaller, lighter, or lower duty actuator can be used in the place of a larger, heavier, or heavier duty actuator, since the amount of force required for actuation of the balanced gate valve 150 is reduced, while maintaining the same or better levels of reliability and performance. This arrangement can ultimately save time, cost, and space on the overall skid and valve tree.

Figure 4:
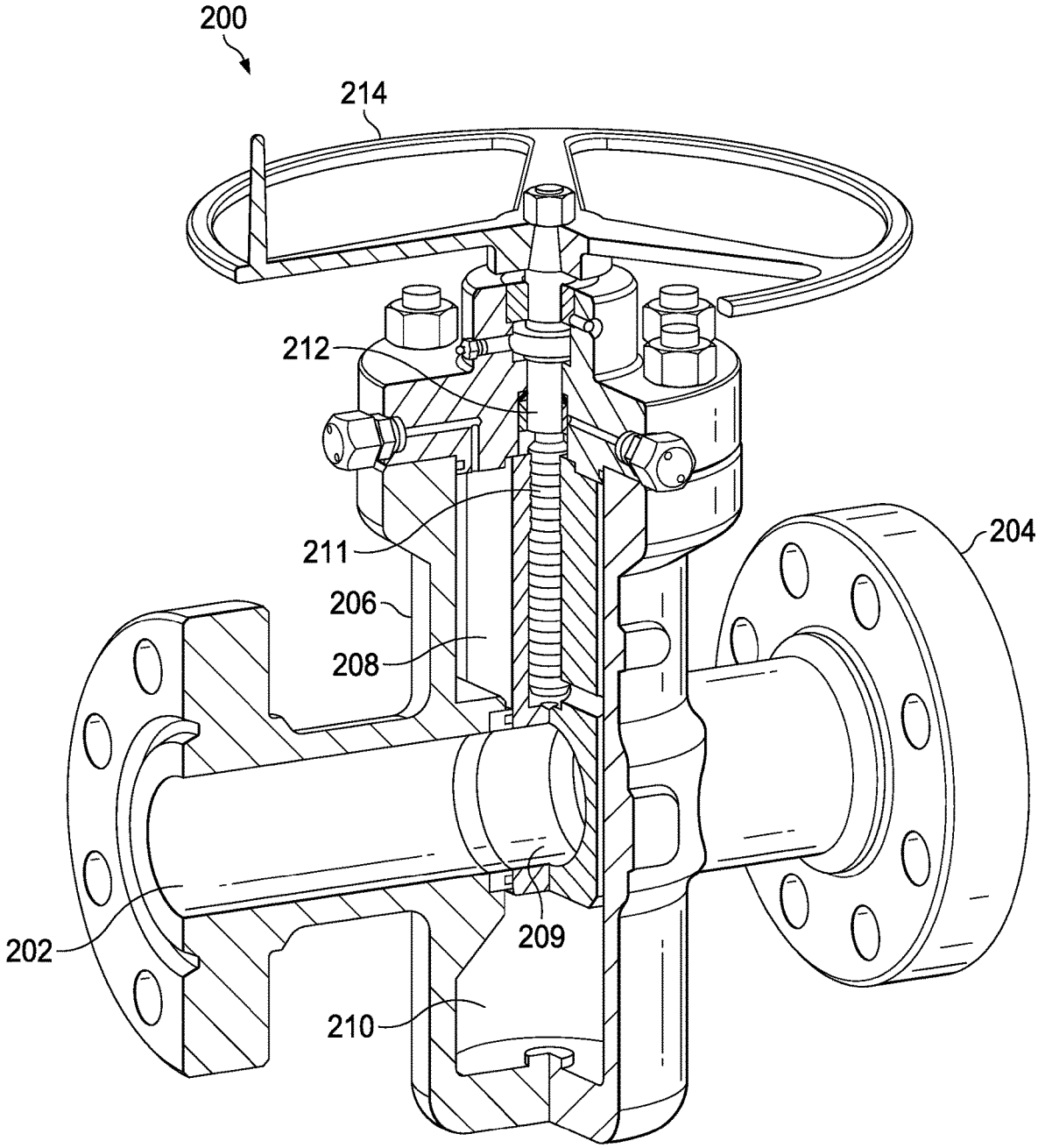
FIG. 4 is a cross-sectional view of a manually actuated direct acting gate valve, according to some embodiments.

In some embodiments, certain fracturing trees can utilize direct acting gate valves as master valves. FIG. 4 is a cross-sectional view of a manually actuated direct acting gate valve 200, according to some embodiments. As described herein, a gate valve is referred to as unbalanced if it does not include a balance stem as described above. Typically, an unbalanced gate valve design is lighter, smaller, less complex, and less expensive than a balanced gate valve. Further, since the direct acting gate valve 200 does not include a balance stem, the direct acting gate valve 200 may have fewer areas for potential leakage across the valve.

In the depicted example, the direct acting gate valve 200 controls flow between an inlet portion 202 and an outlet portion 204 of a valve housing 206. As illustrated, the gate 208 controls the flow in the direct acting gate valve 200. The gate 208 defines an aperture 209 that permits flow through the gate 208 when the aperture 209 is aligned with the inlet portion 202 and the outlet portion 204. The aperture 209 can be defined along a lower portion of the gate 208.

The gate 208 can further include an occlusion portion 211 that is free of any apertures or voids to occlude or block flow through the gate 208 when the occlusion portion 211 is aligned with the inlet portion 202 and the outlet portion 204. The occlusion portion 211 can be defined along an upper portion of the gate 208. The gate 208 can have a rectangular cross-sectional profile, a tapered cross-sectional profile, a wedge cross-sectional profile, or any other cross-sectional profile that allows for the occlusion portion 211 to block flow in the annular region of the gate valve 200.

In an open or operating position of the direct acting gate valve 200, the gate 208 is retracted or moved upward into the valve housing 206 to permit fluid communication between the inlet portion 202 and the outlet portion 204. As illustrated, the gate 208 is moved upward to allow the aperture 209 in the lower portion of the gate 208 to be aligned with the inlet portion 202 and the outlet portion 204, allowing flow therebetween.

During operation, the gate 208 can be moved from a recessed or upward position within the valve housing 206 and an extended or downward position in the gate cavity 210 to obstruct flow from the inlet portion 202 of the valve 200 to the outlet portion 204 of the valve 200. The gate 208 can move downward to align the occlusion portion 211 of the upper portion of the gate 208 with the inlet portion 202 and the outlet portion 204 to block flow therebetween. The relationship between the position of the gate 208 and the flow through the valve can be considered "direct acting."

In the depicted example, the gate 208 is moved or actuated by moving a stem 212 coupled to the gate 208. As illustrated, the stem 212 extends from the gate 208 and through the valve housing 206. In some embodiments, the stem 212 supports, aligns, or otherwise constrains the gate 208 within the valve housing 206. In the depicted example, the gate 208 is supported by a single stem 212 in an unbalanced arrangement. Accordingly, as the stem 212 is moved, the gate 208 moves within the valve housing 206. Further, as illustrated, as the gate 208 moves within the valve housing 206, the stem 212 moves relative to the valve housing 206, in a "rising-stem" arrangement. Advantageously, since the position of the stem 212 relative to the valve housing 206 corresponds to the position of the gate 208 within the valve housing 206, the position of the stem 212 can be used to indicate the position of the gate 208 within the valve 200.

In some embodiments, (such as a manually operated master valve 112) the stem 212 (and therefore the gate 208) can be moved by rotating a wheel 214 that is threadedly engaged to the stem 212. Therefore, the valve 200 can open and close by rotating the wheel 214. As illustrated, the position of the stem 212 relative to the wheel 214 reflects the position of the gate 208.

In some embodiments, (such as actuated master valve 114) the stem 212 (and therefore the gate 208) can be moved by electric, hydraulic, pneumatic, or any other suitable applications of force. In some embodiments, an electronic, hydraulic, and/or pneumatic actuator is coupled to the stem 212.

During operation, net pressure acting in the direction of fluid flow acts upon the direct acting gate valve, creating a force on gate 208. For example, an upward force of the fluid flow can create an upward force on the gate 208, resulting in stem thrust. Stem thrust increases the amount of force required to actuate the direct acting gate valve 200. Unlike the balanced gate valve, the direct acting gate valve 200 does not include a balanced stem to balance the stem thrust in the gate valve 200. Therefore, the direct acting gate valve 200 must overcome the stem thrust in order to actuate. This increases the amount of force required to operate the valve if the pressure across the gate valve 200 is not balanced prior to operation.

Further, the difference in pressure on either side of the gate 208 creates a net force acting on the gate 208, resulting in gate drag, which affects the amount of force needed to actuate the direct acting gate valve 200. During operation, gate draft increases the amount of force needed to actuate the direct acting gate valve 200.

Advantageously, by equalizing the pressures across the direct acting gate valve 200, the amount of force needed to actuate the gate 208 is reduced, which facilitates actuation of the gate 208 to a closed position. Similarly, the pressure across the direct acting gate valve 200 can be equalized to minimize the amount of force needed to open the gate 208.

In some applications, the pressure across the direct acting gate valve 200 can be equalized by activating one or more pumps in fluid communication with the direct acting gate valve 200. In particular, a pump or other flow device can increase or decrease pressure to match or otherwise equal the pressure on the other side of the gate 208.

Advantageously, by equalizing the pressure across the direct acting gate valve 200 prior to or during operation, the force exerted on the components of the direct acting gate valve 200 is reduced, in turn, reducing the wear and tear on the components of the direct acting gate valve 200. Further, in some embodiments, a smaller, lighter, or less costly direct acting gate valve 200 can be used with the same or better levels of reliability and performance when the described method of equalizing pressure prior to actuation is utilized. This is particularly advantageous because an unbalanced gate valve is already smaller than a balanced gate valve. This method not only allows the use of the unbalanced gate valve, but also a smaller unbalanced gate valve.

Further, by equalizing the pressure across the direct acting gate valve 200 prior to or during operation, the force required to actuate the valve is reduced, reducing the manual force required to be exerted to actuate the valve or the force requirements of the actuator. In some embodiments, a smaller, lighter, or lower duty actuator can be used in the place of a larger, heavier, or heavier duty actuator, since the amount of force required for actuation of the direct acting gate valve 200 is reduced, while maintaining the same or better levels of reliability and performance. This arrangement can ultimately save time, cost, and space on the overall skid and valve tree.

As discussed herein, the disclosed valves can be used as master valves that can shut off fluid flow through the fracturing tree in the event of an emergency (also referred to as emergency valves). Therefore, during an emergency situation, it may be desired to easily and rapidly actuate or otherwise move a valve to a closed position. As described with respect to FIGS. 7 and 8, in some applications, the valves described including, but not limited to, the balanced stem gate valve 150 and the direct acting gate valve 200 can have a high closing force that requires the operator to exert a high amount of force or a larger actuator capable of exerting a high amount of force. Further, the amount of closing force required can increase with the amount of pressure experienced by the valves.

Therefore, it is desired to reduce the amount of force needed to close a valve, particularly during an emergency situation. By reducing the amount of force needed to close a valve, an operator may be able to more easily and rapidly close a valve and/or a smaller, less expensive actuator can be utilized with the valve. In some applications, such as certain emergency situations, methods to reduce the amount of closure force required for a valve (such as pressure equalization) may not be available or practical for the operator.

Accordingly, it may be desired to provide a fracturing tree with one or more valves that can be actuated to a closed position with a reduced closing force in an emergency situation where operating methods to reduce the amount of closure force are not available or practical for the operator. As described herein, valves can include certain designs and/or features that allow for lower closing force or closure assistance, including during emergency situations. In some embodiments, the amount of closing force required can decrease in an inverse relationship to the amount of pressure experienced by the valves, meaning the amount of closure force can decrease as the amount of pressure experienced by the valve increases. Further, in certain embodiments, the amount of closure assistance force can exceed the closure force, meaning the valves are "self-closing" or "fail close" and utilize a mechanism to retain the valves in an open position.

In some applications, a valve can be designed or include features to reduce the closing force thereof while increasing the amount of force needed to open the valve. A fracturing tree designer and/or a fracturing tree operator may be willing to accept an arrangement that requires a slightly higher opening force in exchange for greatly reduced closing force, because when using the valves as emergency valves, the operator would require that the valves are actuated to a closed state during emergency situations. For example, an operator may be able to practically employ methods to reduce the amount of opening force needed for the valve, such as pressure equalization, for a valve that has an increased opening force requirement, reducing the requirement for a larger valve based on these methodologies for operation. However, this valve may decrease the requirement of force in an emergency situation, thus increasing the safety of the overall operational methodology.

Figure 5:
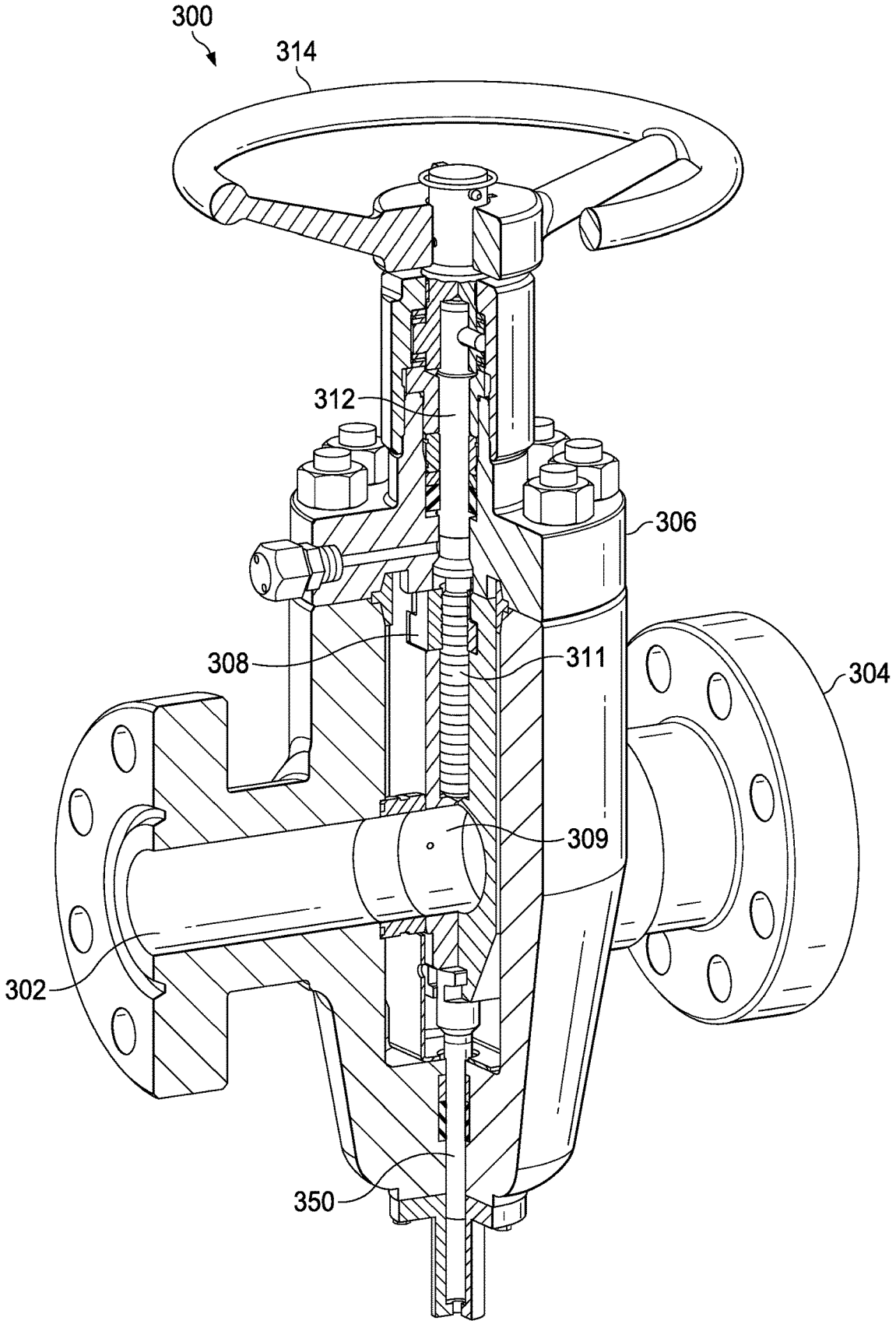
FIG. 5 is a cross-sectional view of a manually actuated direct acting gate valve with a lower translating stem, according to some embodiments.

The valves described herein allow for a reduced closing force as discussed. FIG. 5 is a cross-sectional view of a manually actuated direct acting gate valve 300 with a lower translating stem 350, according to some embodiments. In some embodiments, the direct acting gate valve 300 includes a construction similar to the construction of direct acting gate valve 200, but further includes the lower translating stem 350 which reduces the amount of force needed to close the valve or otherwise assists the valve to a closed position.

In the depicted example, the direct acting gate valve 300 controls flow between an inlet portion 302 and an outlet portion 304 of a valve housing 306. As illustrated, the gate 308 controls the flow in the direct acting gate valve 300. The gate 308 defines an aperture 309 that permits flow through the gate 308 when the aperture 309 is aligned with the inlet portion 302 and the outlet portion 304. The aperture 309 can be defined along a lower portion of the gate 308 in a direct-acting arrangement.

The gate 308 can further include an occlusion portion 311 that is free of any apertures or voids to occlude or block flow through the gate 308 when the occlusion portion 311 is aligned with the inlet portion 302 and the outlet portion 304. The occlusion portion 311 can be defined along an upper portion of the gate 308 in a direct-acting arrangement. The gate 308 can have a rectangular cross-sectional profile, a tapered cross-sectional profile, or a wedge cross-sectional profile.

In an open or operating position of the direct acting gate valve 300, the gate 308 is retracted or moved upward into the valve housing 306 to permit fluid communication between the inlet portion 302 and the outlet portion 304. As illustrated, the gate 308 is moved upward to allow the aperture 309 in the lower portion of the gate 308 to be aligned with the inlet portion 302 and the outlet portion 304, allowing flow therebetween.

During operation, the gate 308 can be moved from a recessed or upward position within the valve housing 306 and an extended or downward position in the gate cavity 310 to obstruct flow from the inlet portion 302 of the valve 300 to the outlet portion 304 of the valve 300. The gate 308 can move downward to align the occlusion portion 311 of the upper portion of the gate 308 with the inlet portion 302 and the outlet portion 304 to block flow therebetween.

In the depicted example, the gate 308 is moved or actuated by moving a stem 312 coupled to the gate 308. As illustrated, the stem 312 extends from the gate 308 and through the valve housing 306. In some embodiments, the stem 312 supports, aligns, or otherwise constrains the gate 308 within the valve housing 306. In the depicted example, the stem 312 is directly or indirectly threadedly coupled to the gate such that rotation of the stem 312 changes the vertical position of the gate 308. In some applications, as the gate 308 rises and falls, the stem 312 remains in the same vertical position and does not translate relative to the valve housing 306.

In some embodiments, (such as a manually operated master valve 112) the stem 312 (and therefore the gate 308) can be moved by rotating a wheel 314 that is coupled to the stem 312. Therefore, the valve 300 can open and close by rotating the wheel 314.

In some embodiments, (such as actuated master valve 114) the stem 312 (and therefore the gate 308) can be moved by electronic, hydraulic, and/or pneumatic force. In some embodiments, an electronic, hydraulic, and/or pneumatic actuator is coupled to the stem 312.

In the depicted example, the direct acting gate valve 300 includes a lower stem 350 to reduce the amount of force needed to move, or otherwise assist, the gate 308 to a closed position. The lower stem 350 extends from the gate 308 and through the valve cavity of the valve housing 306. The lower stem 350 extends from the gate 308 opposite to the stem 312. In some embodiments, the lower stem 350 supports, aligns, or otherwise constrains the gate 308 within the valve housing 306. In the depicted example, the lower stem 350 is coupled to the gate 308 such that the lower stem 350 vertically translates with the gate 308 as the gate 308 rises and falls. In some embodiments, the lower stem 350 may be rotationally constrained to not rotate relative to the gate 308 and/or the valve housing 306.

The inclusion of the lower stem 350 can provide a closure assist to reduce the amount of force needed to close or occlude flow through the direct acting gate valve 300 relative to other valve arrangements. In some embodiments, the amount of closure assistance provided by the lower stem 350 can increase in relationship to the amount of pressure experienced by the direct acting gate valve 300, meaning that the lower stem 350 can provide a greater assistance at high pressures, as described with respect to FIGS. 7 and 8.

In some applications, the pressure across the direct acting gate valve 300 can be equalized to minimize the amount of force needed to open the gate 308. Advantageously, an operator may equalize pressure across the direct acting gate valve 300 prior to or during opening to reduce the amount of opening force needed in embodiments where a valve may have a greater required opening force compared to the closing force. Further, when suitable or practical, pressure across the direct acting valve 300 can be equalized to further reduce the amount of force needed to actuate the gate 308 to a closed position.

Figure 6:
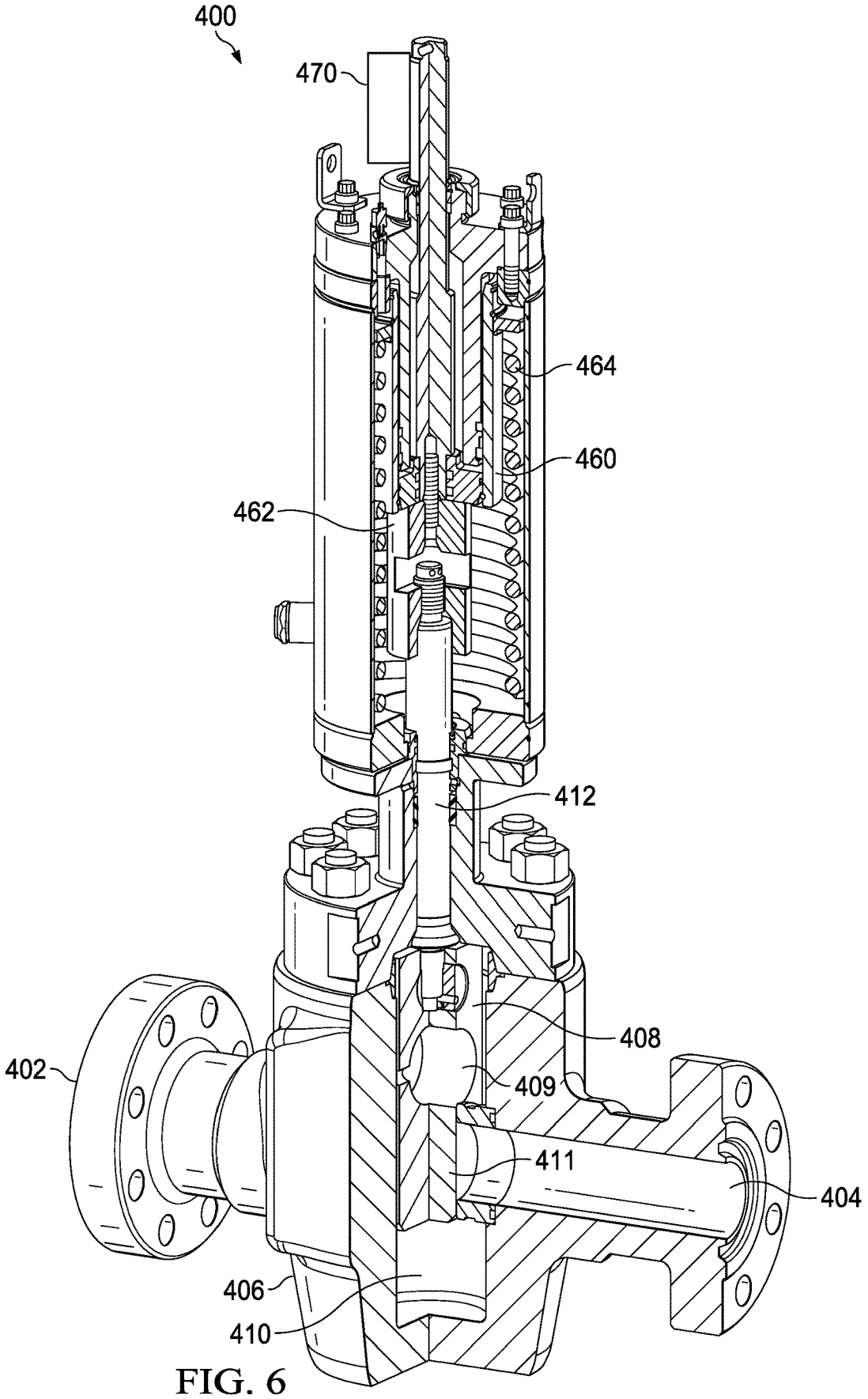
FIG. 6 is a cross-sectional view of a hydraulically actuated reverse acting gate valve, according to some embodiments.

FIG. 6 is a cross-sectional view of a hydraulically actuated reverse acting gate valve 400, according to some embodiments. In the depicted example, the reverse acting gate valve 400 includes a "reverse" gate configuration wherein the gate 408 is moved upward to occlude or block flow and downward to permit flow through the reverse acting gate valve 400. Advantageously, the reverse gate configuration of the reverse acting gate valve 400 reduces the amount of force needed to close the valve or otherwise assists the valve to a closed position.

In the depicted example, the reverse acting gate valve 400 controls flow between an inlet portion 402 and an outlet portion 404 of a valve housing 406. As illustrated, the gate 408 controls the flow in the reverse acting gate valve 400. The gate 408 defines an aperture 409 that permits flow through the gate 408 when the aperture 409 is aligned with the inlet portion 402 and the outlet portion 404. The aperture 409 can be defined along an upper portion of the gate 408 in a reverse-acting arrangement.

The gate 408 can further include an occlusion portion 411 that is free of any apertures or voids to occlude or block flow through the gate 408 when the occlusion portion 411 is aligned with the inlet portion 402 and the outlet portion 404. The occlusion portion 411 can be defined along a lower portion of the gate 408 in a reverse-acting arrangement. The gate 408 can have a rectangular cross-sectional profile, a tapered cross-sectional profile, or a wedge cross-sectional profile.

In the obstructed or closed position of the reverse acting gate valve 400, the gate 408 is retracted or moved upward into the valve housing 406 to obstruct flow from the inlet portion 302 of the valve 400 to the outlet portion 404 of the valve 400. The gate 408 can move upward to align the occlusion portion 411 of the lower portion of the gate 408 with the inlet portion 402 and the outlet portion 404 to block flow therebetween.

During operation, the gate 408 can be moved from a recessed or upward position within the valve housing 406 to an extended or downward position in the gate cavity 410 to permit fluid communication between the inlet portion 402 and the outlet portion 404. In the depicted example, the gate 408 is moved downward to allow the aperture 409 in the upper portion of the gate 408 to be aligned with the inlet portion 402 and the outlet portion 404, allowing flow therebetween. The relationship between the position of the gate 408 and the flow through the valve can be considered "reverse acting."

The reverse acting arrangement of the gate 408 can provide a closure assist to reduce the amount of force needed to close or occlude flow through the reverse acting gate valve 400 relative to other valve arrangements. In some embodiments, the amount of closure assistance provided by the reverse acting gate 408 can increase in relationship to the amount of pressure experienced by the reverse acting gate valve 400, meaning that the reverse acting gate 408 can provide a greater assistance at high pressures, as described with respect to FIGS. 7 and 8. In some embodiments, the amount of closure assistance provided by the reverse acting gate 408 can exceed the required closure force, meaning that the reverse acting gate valve 400 is "self-closing" or "fail close." In some applications, the self-closing force can increase as pressure across the reverse acting gate valve 400 is increased. As described herein, the reverse acting gate valve 400 can utilize a locking mechanism to retain the gate 408 in an open position when desired.

In the depicted example, the gate 408 is moved or actuated by moving a stem 412 coupled to the gate 408. As illustrated, the stem 412 extends from the gate 408 and through the valve housing 406. In some embodiments, the stem 412 supports, aligns, or otherwise constrains the gate 408 within the valve housing 406. In the depicted example, the stem 412 moves or translates with the gate 408 such that the stem 412 moves relative to the valve housing 406 as the gate 408 rises and falls.

In some embodiments, (such as actuated master valve 114) the stem 412 (and therefore the gate 408) can be moved by electric, hydraulic, pneumatic, or any other suitable applications of force. In some embodiments, an electric, hydraulic, and/or pneumatic actuator is coupled to the stem 412.

In the depicted example, the stem 412 is moved by a hydraulic actuator 460 that is coupled to the stem 412 to change the position of the gate 408. In some embodiments, the hydraulic actuator 460 can be a single action piston that urges the gate 408 in a single direction or a double action piston 462 that can move the gate 408 upward or downward. Optionally, the hydraulic actuator 460 includes a spring or biasing member 464 to further urge the stem 412 in a desired direction. In some embodiments, (such as a manually operated master valve 112) the stem 412 (and therefore the gate 408) can be manually actuated by rotating a wheel that is coupled to the stem 412.

In some embodiments, the reverse acting gate valve 400 can include a locking mechanism 470 to prevent the unintended closure of the gate 408 due to the closure force created by the gate 408. The locking mechanism 470 can engage and release the stem 412 directly or indirectly to prevent or allow the gate 408 to move in response to the closure force generated by fluid pressure interacting with the gate 408. The locking mechanism 470 can include a self-locking thread mechanism or a "power screw" mechanism. In some embodiments, the locking mechanism 470 can include a spring-loaded and/or gear-driven braking mechanism that acts upon the stem 412 either directly or indirectly. Embodiments of a locking mechanism are described in U.S. patent application Ser. No. 16/844,626, titled "Actuator with Spring Compression and Decoupling," filed on Apr. 9, 2020, the full disclosure of which is incorporated herein by reference for all intents and purposes.

In some applications, the pressure across the reverse acting gate valve 400 can be equalized to minimize the amount of force needed to open the gate 408. Advantageously, an operator may equalize pressure across the reverse acting gate valve 400 prior to or during opening to reduce the amount of opening force needed in embodiments where a valve may have a greater required opening force compared to the closing force. Further, when suitable or practical, pressure across the reverse acting gate valve 400 can be equalized to further reduce the amount of force needed to actuate the gate 408 to a closed position.

Figure 7:
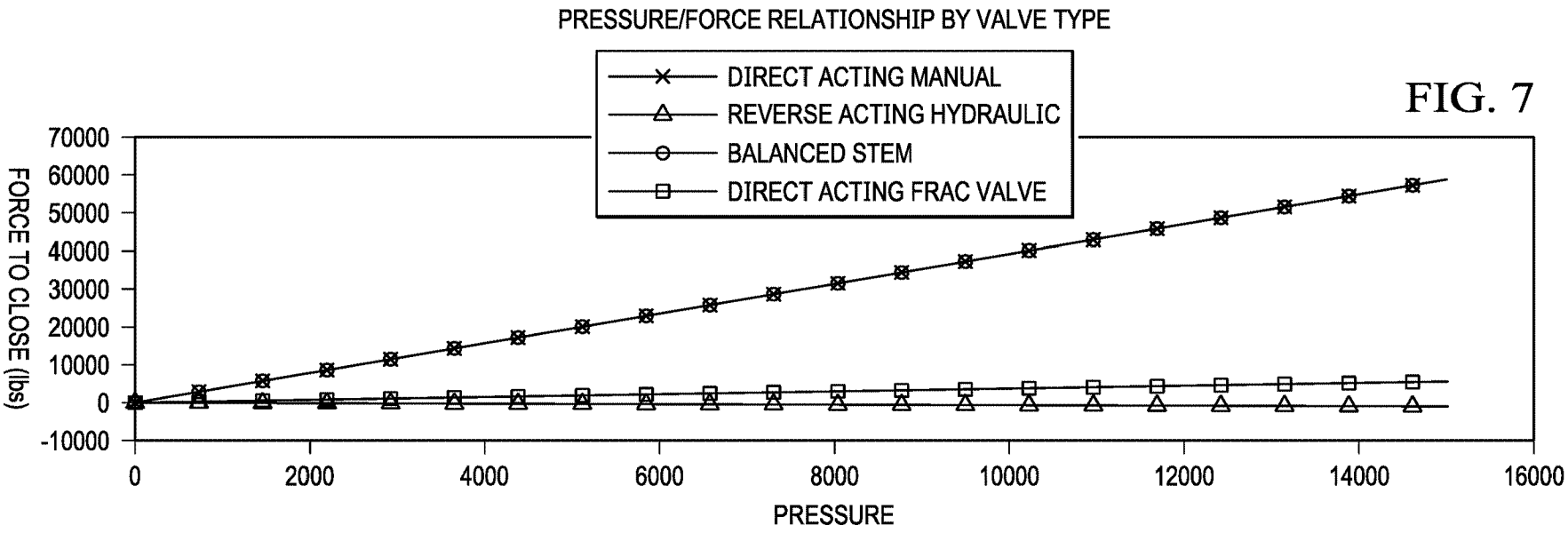
FIG. 7 is a chart illustrating the relationship between a force to close and fluid pressure for various valve types.

FIG. 7 is a chart illustrating the relationship between a force to close and fluid pressure for various valve types. With reference to FIG. 7, the amount of force required (in pounds) is shown for a balanced stem gate valve 150 (both manual and actuated), direct acting gate valve 200, direct acting gate valve 300 (with lower stem), reverse acting gate valve 400 at various pressures.

| Pressure (Closing) in psi | Direct Acting Gate Valve Closure Force (pounds) | Reverse Acting Gate Valve Closure Force (pounds) | Balanced Stem Gate Valve Closure Force (pounds) | Direct Acting Gate Valve With Lower Stem Closure Force (pounds) |
|---|---|---|---|---|
| 0 | 0 | 0 | 0 | 0 |
| 1000 | 3916 | −60 | 3916 | 370 |
| 2000 | 7833 | −120 | 7833 | 739 |
| 3000 | 11749 | −179 | 11749 | 1109 |
| 4000 | 15665 | −239 | 15665 | 1479 |
| 5000 | 19581 | −299 | 19581 | 1849 |
| 6000 | 23498 | −359 | 23498 | 2218 |
| 7000 | 27414 | −419 | 27414 | 2588 |
| 8000 | 31330 | −478 | 31330 | 2958 |
| 9000 | 35247 | −538 | 35247 | 3327 |
| 10000 | 39163 | −598 | 39163 | 3697 |
| 11000 | 43079 | −658 | 43079 | 4067 |
| 12000 | 46995 | −718 | 46995 | 4437 |
| 13000 | 50912 | −777 | 50912 | 4806 |
| 14000 | 54828 | −837 | 54828 | 5176 |
| 15000 | 58744 | −897 | 58744 | 5546 |

As shown in chart of FIG. 7 and the table above, the force required to close the direct acting gate valve 300 and the reverse acting gate valve 400 is significantly lower than the amount of force required to close the balanced stem gate valve 150 and/or the direct acting gate valve 200 at any pressure, allowing the direct acting gate valve 300 and the reverse acting gate valve 400 to be closed with less force in emergency situations. Indeed, the differential between the force required to close the direct acting gate valve 300 and the reverse acting gate valve 400, and the balanced stem gate valve 150 and/or the direct acting gate valve 200 grows at higher pressures. It is noted that the balanced stem gate valve 150 and/or the direct acting gate valve 200 generally require the same closure force at various operating pressures.

Further, as shown in the chart of FIG. 7 and the table above, the direct acting gate valve 300 generally requires about 10% of the closing force of the balanced stem gate valve 150 and/or the direct acting gate valve 200 across all pressures. With respect to the reverse acting gate valve 400, the reverse acting gate valve 400 provides a negative closing force at all pressures, meaning that the reverse acting gate valve 400 urges the gate towards a closed position. As shown in the chart and table above, the amount of assistance or closing force increases as fluid pressure increases.

In some embodiments, fracturing trees, such as fracturing tree 100 can include one or more master valves with different required closing forces (and different required opening forces) to optimize operation of the fracturing tree 100 and the corresponding system. For example, the fracturing tree 100 can include a first master valve 112 that is biased toward a closed position (e.g., requiring a lower closing force than a second master valve 114) and a second master valve 114 that is less biased toward a closed position, balanced (e.g., requiring approximately equal force to close and to open), or biased toward an open position. Advantageously, a fracturing tree 100 with master valves with differing actuation force requirements can allow for master valves that may be intended for shut-off purposes (e.g., the first master valve 112) to be readily closed and/or rapidly closed in an emergency situation (while accepting that the master valve 112 may require a greater opening force than master valve 114 and require equalization to open), while other master valves that may be used more frequently to control operation (e.g. the second master valve 114) to be opened and closed with approximately equal force (or alternatively a greater required closing force and a lower required closing force than the first master valve 112). For example, in some embodiments, a fracturing tree 100 can utilize valves with a lower required closing force, such as the direct acting gate valve 300 or the reverse acting gate valve 400 as the first master valve 112 while utilizing valves that may require more closing force (but less opening force), such as the balanced stem gate valve 150 or the direct acting gate valve 200 as the second master gate valve 114, allowing for emergency shut-off control and balanced force requirements for more often actuated valves.

Figure 8:
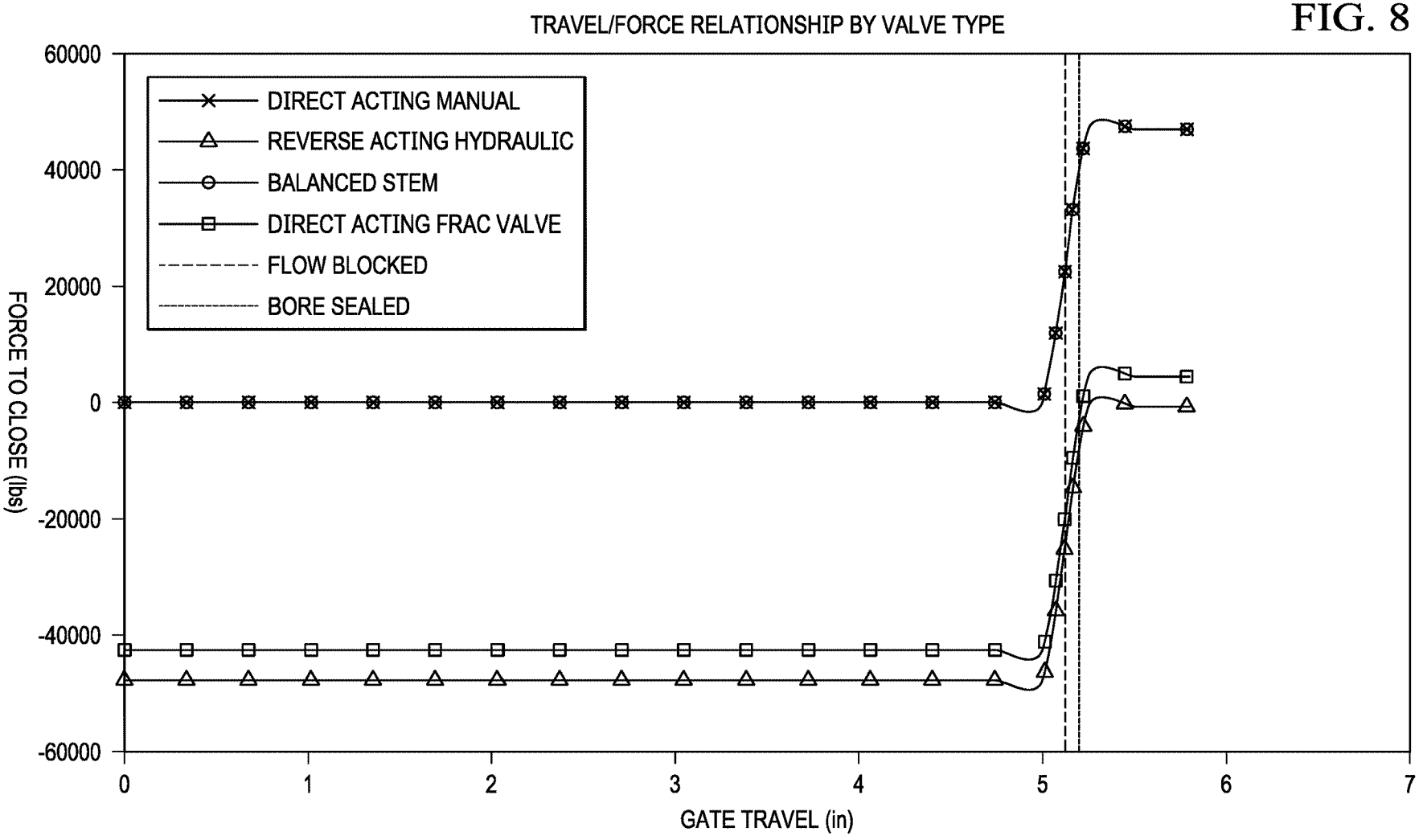
FIG. 8 is a chart illustrating the relationship between a force to close and gate travel for various valve types.

FIG. 8 is a chart illustrating the relationship between a force to close and gate travel for various valve types. With reference to FIG. 8, the amount of force required (in pounds) is shown for a balanced stem gate valve 150 (both manual and actuated), direct acting gate valve 200, direct acting gate valve 300 (with lower stem), reverse acting gate valve 400 at various positions of gate travel at 12,000 psi.

| Gate Travel (in inches @ 12000 psi) | Direct Acting Gate Valve Closure Force (in lbs) | Reverse Acting Gate Valve Closure Force (in lbs) | Balanced Stem Gate Valve Closure Force (in lbs) | Direct Acting Gate Valve With Lower Stem Closure Force (in lbs) |
|---|---|---|---|---|
| 0 | 90 | −47713 | 60 | −42559 |
| 0.25 | 90 | −47713 | 60 | −42559 |
| 0.5 | 90 | −47713 | 60 | −42559 |
| 0.75 | 90 | −47713 | 60 | −42559 |
| 1 | 90 | −47713 | 60 | −42559 |
| 1.25 | 90 | −47713 | 60 | −42559 |
| 1.5 | 90 | −47713 | 60 | −42559 |
| 1.75 | 90 | −47713 | 60 | −42559 |
| 2 | 90 | −47713 | 60 | −42559 |
| 2.25 | 90 | −47713 | 60 | −42559 |
| 2.5 | 90 | −47713 | 60 | −42559 |
| 2.75 | 90 | −47713 | 60 | −42559 |
| 3 | 90 | −47713 | 60 | −42559 |
| 3.25 | 90 | −47713 | 60 | −42559 |
| 3.5 | 90 | −47713 | 60 | −42559 |
| 3.75 | 90 | −47713 | 60 | −42559 |
| 4 | 90 | −47713 | 60 | −42559 |
| 4.25 | 90 | −47713 | 60 | −42559 |
| 4.5 | 90 | −47713 | 60 | −42559 |
| 4.75 | 90 | −47713 | 60 | −42559 |
| 5 | 90 | −47713 | 60 | −42559 |
| 5.25 | 46995 | −718 | 46995 | 4437 |
| 5.5 | 46995 | −718 | 46995 | 4437 |
| 5.75 | 46995 | −718 | 46995 | 4437 |
| 5.8 | 46995 | −718 | 46995 | 4437 |

As shown in chart of FIG. 8 and the table above, the force required to close the direct acting gate valve 300 and the reverse acting gate valve 400 is significantly lower than the amount of force required to close the balanced stem gate valve 150 and/or the direct acting gate valve 200 at any at any position of the gate travel, allowing the direct acting gate valve 300 and the reverse acting gate valve 400 to be closed with less force in emergency situations. It is noted that the balanced stem gate valve 150 and/or the direct acting gate valve 200 generally require the same closure force at various positions of gate travel.

Further, as shown in the chart of FIG. 8 and the table above, the direct acting gate valve 300 and the reverse acting gate valve 400 provide a negative closing force prior to the flow blockage portion of gate travel, meaning that the gate is urged toward a closed position. Both the direct acting gate valve 300 and the reverse acting gate valve 400 require significantly less closure force at the end of gate travel compared to the balanced stem gate valve 150 and/or the direct acting gate valve 200.

It is understood that variations may be made in the foregoing without departing from the scope of the present disclosure. In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

The invention claimed is:

1. A composite fracturing tree comprising:

a first operating valve;

a first master valve comprising:

a first inlet portion;

a first outlet portion; and a first gate portion disposed between the first inlet portion and the first outlet portion, wherein the first gate portion is moveable between a flow position, permitting flow between the first inlet portion and the first outlet portion, and an occluding position, preventing flow from the first inlet portion to the first outlet portion, wherein the first gate portion is actuated from the flow position to the occluding position via a first closing force and from the occluding position to the flow position via a first opening force; and a second master valve in fluid communication with the first master valve and the first operating valve, the second master valve comprising:

a second inlet portion in fluid communication with the first operating valve;

a second outlet portion; and a second gate portion disposed between the second inlet portion and the second outlet portion, wherein the second gate portion is moveable between a flow position, permitting flow between the second inlet portion and the second outlet portion, and an occluding position, preventing flow from the second inlet portion to the second outlet portion, wherein the second gate portion is actuated from the flow position to the occluding position via a second closing force and from the occluding position to the flow position via a second opening force, wherein the first closing force is less than the second closing force, the second closing force is less than the second opening force, and the second opening force is less than the first opening force.

2. The composite fracturing tree of claim 1, further comprising a second operating valve in fluid communication with the first operating valve.

3. The composite fracturing tree of claim 1, wherein the first master valve is a reverse acting gate valve.

4. The composite fracturing tree of claim 1, wherein the second gate portion is actuated by hydraulics, pneumatics, or electricity.

5. The composite fracturing tree of claim 1, wherein the second master valve is a direct acting gate valve.

6. The composite fracturing tree of claim 1, wherein fluid pressure exerted on the first and second gate portions provides a respective biasing force on the respective first and second gate portions toward the respective occluding positions.

* * * * *